United States Patent [19]

Innocenti

[11] 3,952,451

[45] Apr. 27, 1976

[54] MODEL AIRPLANE TRACK

[75] Inventor: Emil G. Innocenti, Hawthorne, N.J.

[73] Assignee: The Raymond Lee Organization, Inc., New York, N.Y.

[22] Filed: Nov. 4, 1974

[21] Appl. No.: 520,300

[52] U.S. Cl. ..... 46/249; 46/1 H; 46/216

[51] Int. Cl.[2] ..... A63H 27/04

[58] Field of Search ..... 46/1 H, 243 M, 243 AV, 46/216

[56] References Cited

UNITED STATES PATENTS

| | | | |
|---|---|---|---|
| 3,202,425 | 8/1965 | Van Hennik | 46/243 AV |
| 3,548,535 | 12/1970 | Bryan | 46/75 |
| 3,604,148 | 9/1971 | Neuhierl | 46/216 |
| 3,838,855 | 10/1974 | Becker | 46/1 H |

*Primary Examiner*—Louis G. Mancene
*Assistant Examiner*—Robert F. Cutting
*Attorney, Agent, or Firm*—Howard I. Podell

[57] ABSTRACT

A model airplane track on which a motorized model airplane wheels around the track. Conductive metal strips on the top face of the track form a closed looped electric circuit to a control panel and power supply. Conductive prongs are connected to an electric motor within the model airplane which rotates the wheels and propels the airplane around the track. The track is mounted on supports so as to raise the airplane above the floor, except in the area of an airport section of the track.

1 Claim, 8 Drawing Figures

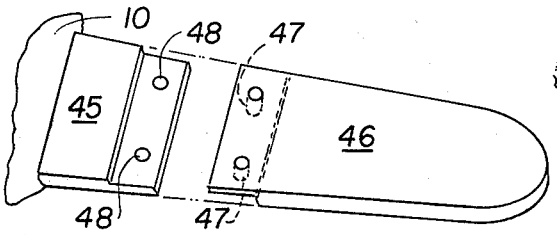
FIG.6
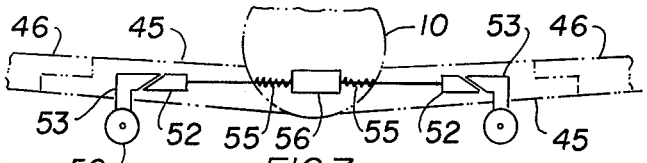
FIG.7a
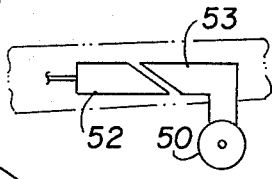
FIG.7b
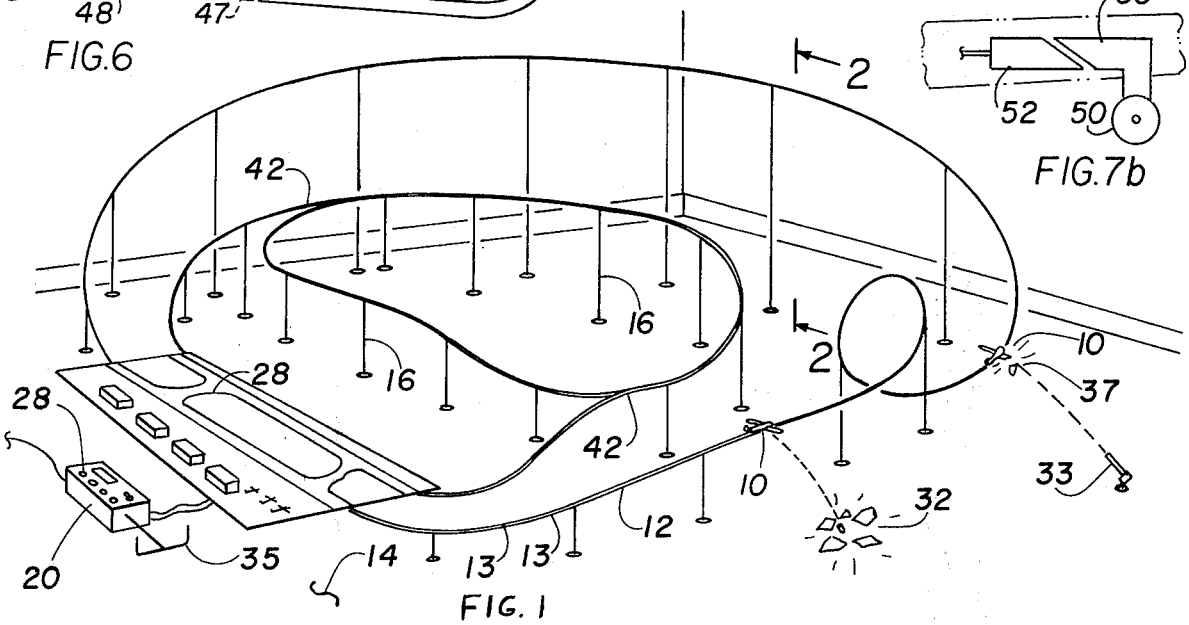
FIG. 1
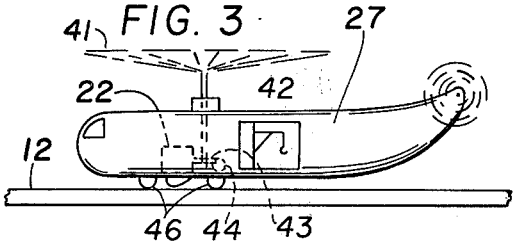
FIG. 3
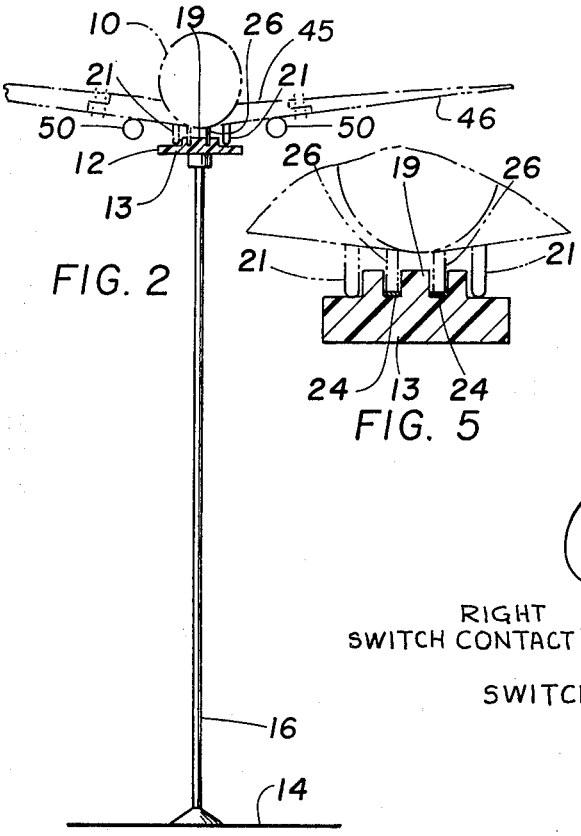
FIG. 2
FIG. 5
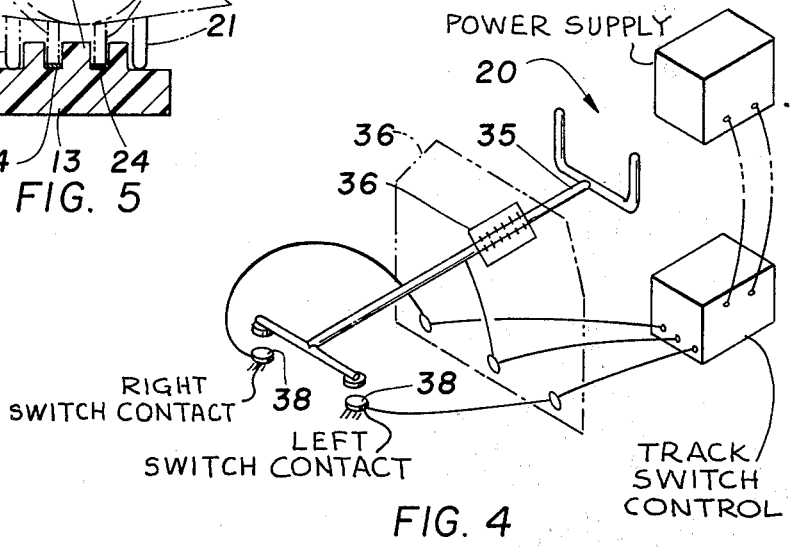
FIG. 4

MODEL AIRPLANE TRACK

SUMMARY OF THE INVENTION

My invention relates to a model airplane and track on which the airplane rides, with the airplane wheels rotated by an internal electric motor. Guide pins mounted on the underside of the plane each extend into a continuous slot aperture traversing the length of the track with conductive metal-coated strips on the surface of the slots forming a closed looped electric circuit connected to the control panel and power supply. The guide pins on the airplane contact the conductive strips, and carry the electric current to a motor inside the airplane. The track is mounted on support rods of various heights so that the track is elevated off the floor, except at an airport section of the track.

BRIEF DESCRIPTION OF THE DRAWING

The objects and features of the invention may be understood with reference to the following detailed description of an illustrative embodiment of the invention, taken together with the accompanying drawings in which:

FIG. 1 illustrates a perspective view of the invention in use;

FIG. 2 illustrates an end sectional view of the invention;

FIG. 3 illustrates a side view of the invention;

FIG. 4 illustrates a schematic diagram of the control panel of the device;

FIG. 5 is a sectional view of the track of the invention;

FIG. 6 is an exploded view of a wing of the airplane of the invention;

FIG. 7A is a sectional view of the wing and bomb release mechanism; and

FIG. 7B is a fragmentary view of the bomb release mechanism in the release position.

DESCRIPTION OF THE PREFERRED EMBODIMENT

Turning now descriptively to the drawings, in which similar reference characters denote similar elements throughout the several views, FIG. 1 shows a toy for children comprising a motorized model airplane 10 with motor assembly 11 which wheels around a closed looped track 12. The track 12 is constructed of a plurality of individual track members 13 joined together to form a continuous closed loop system. The track members 13 can be placed on a table top 14 or raised on supports 16, as shown in FIG. 2, mounted above the support surface 14.

An airport section 28 may be mounted on the support surface 14 with the track 12 depressed from its elevation position to lie along the airport section. The power supply and control box 20 may be located adjacent the airport section 28, with the control box fitted with an operating handle 35.

As shown in FIG. 4, the handle 35 may be shaped similarly to an airplane control lever and mounted externally to a side 36 of the control box 20 so as to be slidable into or away from the control box side 36. A resistance unit 36 fitted to the interior section of the control handle serves to regulate the speed of the motor 22 inside the airplane when the handle is moved in relation to the resistance unit, with the control handle mounted also so as to rotate, to operate the right or left switch contacts 38 and to throw all the track switches 42 to the right or left respectively.

As shown in FIG. 2 and FIG. 5, the airplane 10 is mounted on motorized wheels 21 which ride on the track 13 on each side of a continuous upraised guide section 19. Two continuous slots 24, each carrying an exposed electrical conductor are mounted in the guide section 19 with two metal prongs 26 that contact the track conductors carrying the electric current to the motor 22. The airplane 10 is fitted with a wing stub 45 that is detachably joined to a wing tip 46 so that the outer tip 46 will detach from the wing stub, when hit by a pellet 37 from toy gun 33. Outer tip 46 is fitted with pins 47 that snugly fit mating holes 48 in the wing stub along the parting surfaces of the wing tip 46 and wing stub 45, as shown in FIG. 6.

As shown in FIG. 3, a helicopter 27 may be substituted for the airplane 10, with the helicopter rotor 41 rotating when rotor shaft 42 is revolved by gear 43 on the shaft which is meshed with gear 44 that is fitted on the axle of a landing gear wheel 46.

The control box 20 may be fitted with buttons 28 to operate remote-controlled devices in the airplane, in the conventional manner, with such remote-controlled devices including a bomb drop mechanism that drops a bomb 32 on the support surface 14 from the airplane 10, as shown in FIG. 1.

As shown in FIGS. 7A and 7B, the bomb 50 is attached to an angle bracket 53 fitted with a tapered surface that abuts a mating tapered surface of the bomb latch member 52 to hold the bomb 50 in latched position shown in FIG. 7A, with latch 52 held against bracket 53 by compression spring 55, which is joined at one end to rotary wheel 56. Rotation of wheel 56 by electrical means triggered by an electrical pulse in the track circuit causes latch member 52 to retract away from bomb angle bracket 53 to permit the bomb 50 to fall freely.

A toy artillery gun 33 may be mounted on the support surface to eject a pellet 37 at the airplane 10, with gun 33 electrically controlled by a control panel switch button 28.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A toy airplane and track assembly comprising a track which may be mounted on vertical support members and an airplane-shaped vehicle fitted with wheels which ride on said track, said vehicle wheels being driven by an electrical motor in the vehicle, together with means to conduct electricity from an external control panel and power supply mounted on the track and means to conduct electricity from the track to the airplane motor mounted on the airplane vehicle, in which the airplane-shaped vehicle is fitted with detachable wing sections which separate from the vehicle when hit by a pellet from a toy gun.

* * * * *